US008149552B1

(12) United States Patent
Cordill

(10) Patent No.: US 8,149,552 B1
(45) Date of Patent: Apr. 3, 2012

(54) DOWNHOLE MEASUREMENT TOOL CIRCUIT AND METHOD TO BALANCE FAULT CURRENT IN A PROTECTIVE INDUCTOR

(75) Inventor: Leroy David Cordill, Bartlesville, OK (US)

(73) Assignee: Automation Solutions, LLC, Paul Valley, OK (US)

( * ) Notice: Subject to any disclaimer, the term of this patent is extended or adjusted under 35 U.S.C. 154(b) by 511 days.

(21) Appl. No.: 12/485,557

(22) Filed: Jun. 16, 2009

Related U.S. Application Data

(60) Provisional application No. 61/133,417, filed on Jun. 30, 2008.

(51) Int. Cl.
*H02H 3/00* (2006.01)

(52) U.S. Cl. ..... 361/42

(58) Field of Classification Search ..... 361/42
See application file for complete search history.

(56) References Cited

U.S. PATENT DOCUMENTS

| | | | | |
|---|---|---|---|---|
| 5,282,508 | A * | 2/1994 | Ellingsen et al. | 166/249 |
| 5,323,855 | A * | 6/1994 | Evans | 166/248 |
| 5,515,038 | A | 5/1996 | Smith | |
| 6,176,308 | B1 | 1/2001 | Pearson | |
| 7,287,591 | B2 * | 10/2007 | Campbell | 166/305.1 |

* cited by examiner

*Primary Examiner* — Stephen W Jackson
(74) *Attorney, Agent, or Firm* — Head, Johnson & Kachigian, P.C.

(57) ABSTRACT

A downhole measurement tool circuit and method to balance fault current in a protective inductor, which keeps an alternating current balanced in a protective choke during a phase-to-ground fault condition in a power cable or a downhole motor of an electrical submersible pump. The downhole measurement tool circuit and method cause a conducting of current during the negative polarity voltage portions of a phase-to-ground fault condition, but do not cause a conduction of negative polarity voltage during use of a negative polarity megger.

21 Claims, 1 Drawing Sheet

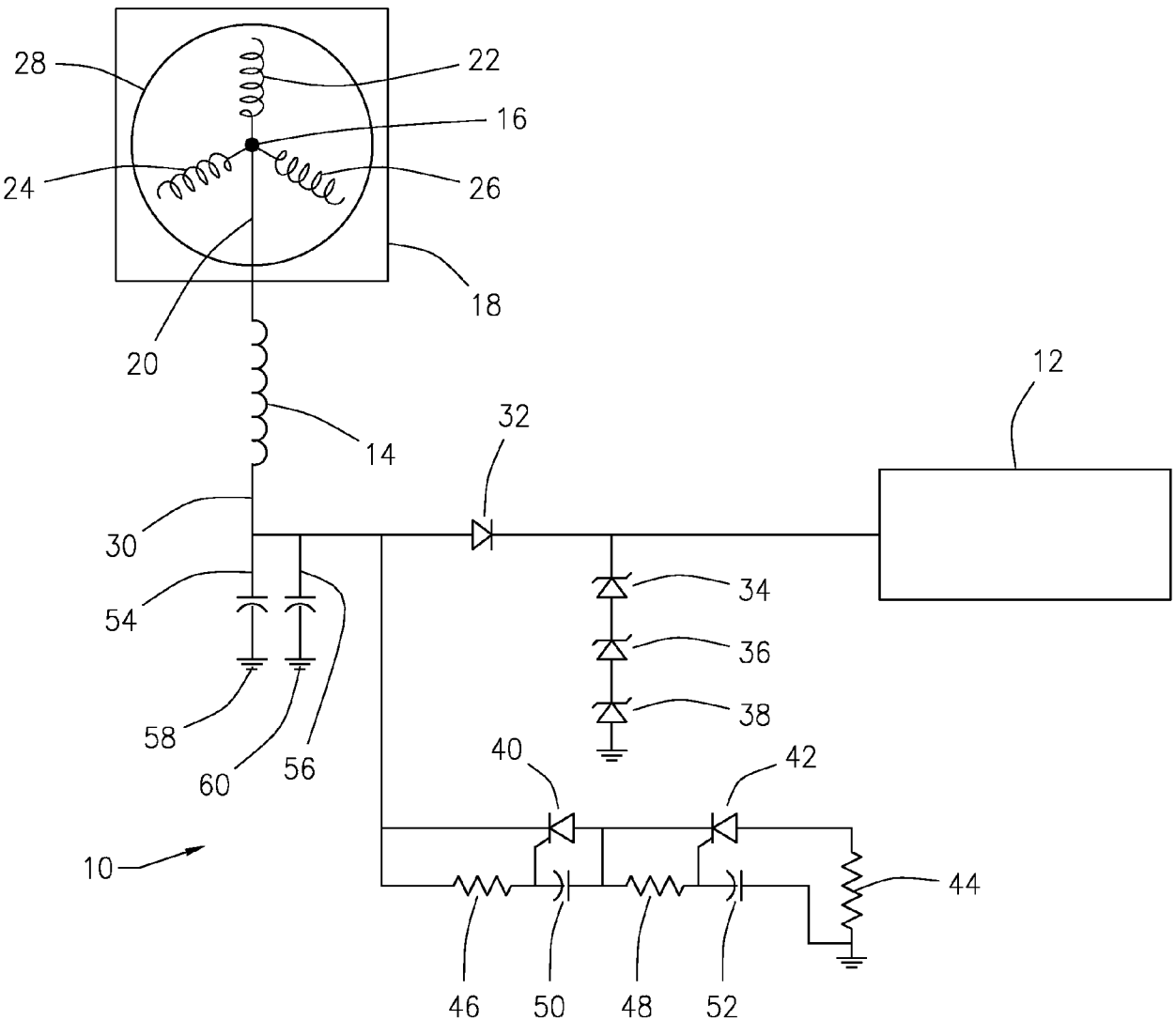
12
44
42
34
36
38
52
48
50
40
46
32
22
16
26
18
14
56
60
58
20
30
54
10
28
24

DOWNHOLE MEASUREMENT TOOL CIRCUIT AND METHOD TO BALANCE FAULT CURRENT IN A PROTECTIVE INDUCTOR

CROSS-REFERENCE TO RELATED APPLICATIONS

This application claims priority to U.S. Provisional Application Ser. No. 61/133,417, filed Jun. 30, 2008, which is incorporated herein by reference.

BACKGROUND OF THE INVENTION

1. Field of the Invention

This invention relates generally to a downhole measurement tool circuit and method to balance fault current in a protective inductor, and more particularly to a downhole measurement tool circuit and method to balance fault current in a protective inductor which keeps an alternating current balanced in a protective choke during a phase-to-ground fault condition in a power cable or a downhole motor of an electrical submersible pump.

2. Description of the Related Art

Various types of downhole equipment, such as pumps and similar devices, are used to move fluids from beneath the surface of the earth to the surface. Well known applications include oil and gas wells and water wells. A typical downhole arrangement would include a string composed of a series of tubes or tubing suspended from the surface. One type of well-known pump is a downhole electrical submersible pump. The electrical submersible pump either includes or is connected to a downhole motor which is sealed so that the whole assembly is submerged in the fluid to be pumped. The downhole motor is connected to a three-phase power source at the surface and operates beneath the level of fluid downhole in order to pump the fluid to the surface.

In the common design of many downhole measurement tools associated with an electrical submersible pump, they are connected to the Y-point of the downhole motor of the electrical submersible pump and to the ground of the downhole system, such as disclosed in U.S. Pat. No. 6,176,308, which is incorporated herein by reference. The three-phase power supply for the electrical submersible pump is isolated from the ground, and the downhole measurement tool utilizes this feature to communicate to an associated surface equipment of a downhole system by low frequency modulation of a current or voltage supplied by the associated surface equipment. The downhole measurement tool is coupled to the electrical submersible pump and used to monitor certain downhole parameters, such as pressure and temperature, of a subterranean bore-hole.

If a phase-to-ground fault occurs in the downhole motor or power cable of the downhole system, this will apply high voltage alternating current to the Y-point of the downhole motor of the electrical submersible pump, and consequently to the downhole measurement tool. To prevent damage to the downhole measurement tool during this fault condition, a protective choke is typically included in the circuitry of the downhole measurement tool, which provides a suitably high impedance to minimize the alternating current flowing from the Y-point to the ground of the downhole system through the circuitry of the downhole measurement tool.

Another typical requirement of many downhole measurement tools is to be able to use a negative polarity, direct current megger to check the electrical insulation quality of the power cable and/or downhole motor of the downhole system.

For this purpose, the circuitry of the downhole measurement tool typically includes a diode, which only conducts during positive polarity voltage. However, since the diode only conducts in the positive polarity voltage, during a phase-to-ground fault of alternating current voltage, the current in the protective choke will reach a direct current level which saturates the choke, and lowers its inductance, accordingly reducing its protective function. In order to eliminate this saturation condition, a large capacitor is typically included in the circuitry of the downhole measurement tool in order to keep the choke current balanced during a phase-to-ground fault condition. The voltage and temperature ratings, plus the large physical sizes required by suitable chokes and capacitors cause them to be expensive and physically large, which may involve additional mechanical mounting considerations as described by U.S. Pat. No. 6,176,308.

It is therefore desirable to provide a downhole measurement tool circuit and method to balance fault current in a protective inductor that keeps a protective choke current balanced in the event of a phase-to-ground fault in a power cable or a downhole motor of an electrical submersible pump of a downhole system.

It is further desirable to provide a downhole measurement tool circuit and method to balance fault current in a protective inductor which eliminates the need for a large, expensive capacitor for protection against choke saturation, thereby reducing the size and cost of the downhole measurement tool.

It is still further desirable to provide a downhole measurement tool circuit and method to balance fault current in a protective inductor which causes a conducting of current during the negative polarity voltage portions of a phase-to-ground fault condition, but which do not cause a conduction of negative polarity voltage during use of a negative polarity megger.

SUMMARY OF THE INVENTION

In general, in a first aspect, the invention relates to a downhole system capable of balancing an alternating current between a power cable or a downhole motor of an electrical submersible pump and a downhole measurement tool during a phase-to-ground fault condition. The downhole system comprises an electrical coupling between a Y-point of the downhole motor of the electrical submersible pump and the downhole measurement tool and a triggerable network that selectively conducts during application of a negative polarity voltage to the downhole measurement tool based on a rate of increase of the negative polarity voltage. The downhole system may include an inductor electrically coupled to the Y-point of the downhole motor of the electrical submersible pump and the downhole measurement tool. The inductor is of selected inductance for filtering alternating current ripple voltage from the downhole motor of the electrical submersible pump to the downhole measurement tool.

The triggerable network of the downhole system may comprise a silicon-controlled rectifier and an associated resistor that form a path of current conduction for the negative polarity voltage during the phase-to-ground fault condition. The triggerable network may further comprise a gate input of the silicon-controlled rectifier coupled to a resistor and a capacitor connected in series. The silicon-controlled rectifier may be a plurality of silicon-controlled rectifiers coupled to a plurality of resistors and a plurality of capacitors connected in series. The resistors and the capacitors may provide a trigger current for the silicon-controlled rectifiers, and the resistors and the capacitors may selectively control the conduction of the silicon-controlled rectifiers. The trigger current may be based on the rate of increase of the negative polarity voltage.

In addition, the downhole system may include a diode providing a path of current conduction for a positive polarity voltage during the phase-to-ground fault condition and a plurality of zener diodes coupled in series and in a reverse-bias mode to limit the voltage resulting from the positive polarity voltage.

In general, in a second aspect, the invention relates to a downhole measurement tool having a circuit capable of balancing an alternating current during a phase-to-ground fault condition, with the downhole measurement tool capable of being coupled to a Y-point of a three-phase downhole motor of an electrical submersible pump. The circuit of the downhole measurement tool includes a triggerable network that selectively conducts during application of a negative polarity voltage to the downhole measurement tool based on a rate of increase of the negative polarity voltage and an inductor commutating circuit to limit the voltage resulting from a positive polarity voltage during the phase-to-ground fault condition.

The triggerable network of the downhole measurement tool may be constructed of a silicon-controlled rectifier and an associated resistor that form a path of current conduction for the negative polarity voltage during the phase-to-ground fault condition. The triggerable network can further comprise a gate input of the silicon-controlled rectifier coupled to a resistor and a capacitor connected in series. Additionally, the silicon-controlled rectifier can be a plurality of silicon-controlled rectifiers coupled to a plurality of resistors and a plurality of capacitors, which are connected in series. The resistors and the capacitors of the downhole measurement tool may provide a trigger current for the silicon-controlled rectifiers, and the resistors and the capacitors can selectively control the conduction of the silicon-controlled rectifiers. Further, the trigger current may be based on the rate of increase of the negative polarity voltage. Moreover, the inductor commutating circuit of the downhole measurement tool can include a diode providing a path of current conduction for a positive polarity voltage during the phase-to-ground fault condition and a plurality of zener diodes coupled in series and in a reverse-bias mode to limit the voltage resulting from the positive polarity voltage. The downhole measurement tool may also include an inductor being of selected inductance for filtering alternating current ripple voltage to the downhole measurement tool.

In general, in a third aspect, the invention relates to a method of balancing a phase-to-ground fault condition between a power cable or a three-phase downhole motor of an electrical submersible pump and a downhole measurement tool. The method comprises the steps of electrically coupling to a Y-point of the downhole motor of the electrical submersible pump to the downhole tool; selectively conducting a negative polarity voltage to the downhole measurement tool during the phase-to-ground fault condition based on a rate of increase of the negative polarity voltage; and providing a path of current conduction for a positive polarity voltage during the phase-to-ground fault condition.

The step of selectively conducting the negative polarity voltage may be via a triggerable network comprising a silicon-controlled rectifier and a network of resistors and capacitors that form a path of current conduction for the negative polarity voltage during the phase-to-ground fault condition. The method may further include the step of providing a trigger current for the silicon-controlled rectifier based on the rate of increase of the negative polarity voltage. If the rate of increase of the negative polarity voltage is sufficient, the method causes the network of resistors and capacitors to provide the trigger current sufficient to trigger the silicon-controlled rectifier thereby causing the silicon-controlled rectifier to conduct current during the negative polarity voltage of the phase-to-ground fault condition. If the rate of increase of the negative polarity voltage is insufficient, the method causes the network of resistors and capacitors to provide the trigger current insufficient to trigger the silicon-controlled rectifier whereby the silicon-controlled rectifier does not conduct current.

BRIEF DESCRIPTION OF THE DRAWINGS

FIG. 1 is an electrical schematic of an example of the circuitry of the downhole measurement tool in accordance with an illustrative embodiment of the downhole measurement tool circuit and method to balance fault current in a protective inductor disclosed herein.

Other advantages and features will be apparent from the following description, and from the claims.

DETAILED DESCRIPTION OF THE INVENTION

The circuits and methods discussed herein are merely illustrative of specific manners in which to make and use this invention and are not to be interpreted as limiting in scope.

While the circuits and methods have been described with a certain degree of particularity, it is to be noted that many modifications may be made in the details of the construction and the arrangement of the electrical components and steps without departing from the spirit and scope of this disclosure. It is understood that the circuits and methods are not limited to the embodiments set forth herein for purposes of exemplification.

A downhole measurement tool circuit and method 10 is provided herein to balance fault current in a protective inductor and relates to any electrical apparatus, in particular a downhole measurement tool 12, which is protected from phase-to-ground fault currents by a protective choke 14. The circuit and method 10 apply to the downhole measurement tool 12 electrically coupled through a lead 20 to the Y-point 16 of an electrical submersible pump 18. The electrical submersible pump 18 includes a downhole motor 28 that has three field coils 22, 24 and 26, with each of the field coils 22, 24 and 26 having a common connection at one end, the Y-point 16, and their other ends are respectively coupled through leads to a source of three-phase power (not shown). The source of three-phase power produces alternating voltage on the three field power leads, which are out of phase with respect to one another by one hundred and twenty degrees.

The Y-point 16 of the downhole motor 28 of the electrical submersible pump 18 is electrically coupled through the lead 20 to one end of an inductor, i.e., the protective choke 14, for filtering alternating current ripple voltage from getting to the downhole measurement tool 12 and the other end of the protective choke 14 is connected to additional circuitry, as appropriate, of the downhole measurement tool 12 via the circuit 10 provided herein. The path of positive current during normal, no-fault condition of the downhole measurement tool 12 flows from the protective choke 14 through a lead 30 and a diode 32 to the additional circuitry of the downhole measurement tool 12. When a phase-to-ground fault is detected, which applies high alternating current voltage to the Y-point 16, the diode 32 provides the path of current conduction during positive polarity voltage resulting from the phase-to-ground fault condition. An array of zener diodes 34, 36 and 38 are coupled in series and clamp the voltage resulting from the positive polarity voltage to prevent damage to the additional circuitry of the downhole measurement tool. During use of a negative polarity megger (not shown), the diode 32 does not conduct and should be of sufficient reverse voltage rating to allow use of the megger.

The circuit and method 10 disclosed herein further include silicon-controlled rectifiers 40 and 42, with associated resistor 44, which form a path for current during the negative polarity portion of alternating current voltage during a phase-to-ground fault condition. Resistor 44 should be sized to conduct approximately the same current during the negative polarity voltage as the diode 32 during the positive polarity voltage. The gate inputs of the silicon-controlled rectifiers 40 and 42 are coupled to resistors 46 and 48 and capacitors 50 and 52 to form a triggerable network, which provides sufficient trigger current to the associated silicon-controlled rectifiers 40 and 42 when a negative voltage with a rapid rise time is present on the Y-point 16, such as during a phase-to-ground fault condition. Silicon-controlled rectifiers 40 and 42 may be of the sensitive-gate type, such that only a small amount of gate trigger current is required to trigger the silicon-controlled rectifiers 40 and 42 into a conducting state. Resistors 46 and 48 reduce false triggering of the silicon-controlled rectifiers 40 and 42, and capacitors 50 and 52 should be sized such that an adequate trigger current is available to the gate inputs of silicon-controlled rectifiers 40 and 42 when the phase-to-ground fault condition is present. During use of the negative polarity megger, the rate of negative polarity voltage increase is much lower, and thus the trigger current through capacitors 50 and 52 is not sufficient to provide an adequate trigger current to the gate inputs of silicon-controlled rectifiers 40 and 42, and thus silicon-controlled rectifiers 40 and 42 do not turn on into a conducting state. Silicon-controlled rectifiers 40 and 42 and capacitors 50 and 52 should have a sufficient voltage withstand rating to allow the use of the megger direct current voltage. Additionally, capacitors 54 and 56 provide additional protection from false triggering of silicon-controlled rectifiers 40 and 42. Similarly to capacitors 50 and 52, capacitors 54 and 56 should have a sufficient voltage withstand rating to allow use of the megger. In addition, capacitors 54 and 56 may be electrically coupled to grounds 58 and 60, respectively.

While the foregoing exemplification utilizes two (2) silicon-controlled rectifiers, 40 and 42, it will be appreciated in keeping with the spirit and scope of the circuit and method 10 disclosed herein that the number of silicon-controlled rectifiers required is dependent on the voltage rating of the silicon-controlled rectifiers and associated electrical components. In addition, it will be appreciated that the number of silicon-controlled rectifiers required is also dependent on the desired megger voltage rating.

For purposes of exemplification and not by way of limitation, the circuit and method 10 disclosed herein may utilize the protective choke 14 having a value of approximately 150 to approximately 200 Henries and suitable for approximately 12 mA of direct current. In addition, the diode 32 may have a voltage rating of approximately 2,000 volts and be rated at about 0.5 amp. Moreover, each of the zener diodes 34, 36 and 38 may be rated at approximately 10 volts each and be suitable for the current and power dissipation during a phase-to-ground fault condition. Again, silicon-controlled rectifiers 40 and 42 may be sensitive gate type silicon-controlled rectifiers, with each rated at about 800 volts, 2 amps, and 200 microamp gate current. Resistors 46 and 48 may each have a value of approximately 2400 ohm, while resistor 44 may have a value of approximately 1000 ohms, and be sized to dissipate adequate power during the phase-to-ground fault condition. Capacitors 50, 52, 54 and 56 may each be rated at approximately 0.1 uFd and 1000 volts.

Whereas, the circuits and methods have been described in relation to the drawings and claims, it should be understood that other and further modifications, apart from those shown or suggested herein, may be made within the spirit and scope of this invention.

What is claimed is:

1. A downhole system capable of balancing an alternating current between a power cable or a downhole motor of an electrical submersible pump and a downhole measurement tool during a phase-to-ground fault condition, said downhole system comprising:

an electrical coupling between a Y-point of said downhole motor of said electrical submersible pump and said downhole measurement tool; and a triggerable network that selectively conducts during application of a negative polarity voltage to said downhole measurement tool based on a rate of increase of said negative polarity voltage.

2. The downhole system of claim 1 wherein said triggerable network comprises a silicon-controlled rectifier and an associated resistor that form a path of current conduction for said negative polarity voltage during said phase-to-ground fault condition.

3. The downhole system of claim 2 wherein said triggerable network further comprises a gate input of said silicon-controlled rectifier coupled to a resistor and a capacitor connected in series.

4. The downhole system of claim 3 wherein said silicon-controlled rectifier is a plurality of silicon-controlled rectifiers coupled to a plurality of resistors and a plurality of capacitors connected in series.

5. The downhole system of claim 4 wherein said resistors and said capacitors provide a trigger current for said silicon-controlled rectifiers, and wherein said resistors and said capacitors selectively control said conduction of said silicon-controlled rectifiers.

6. The downhole system of claim 5 wherein said trigger current is based on said rate of increase of said negative polarity voltage.

7. The downhole system of claim 1 further comprising a diode providing a path of current conduction for a positive polarity voltage during said phase-to-ground fault condition and a plurality of zener diodes coupled in series and in a reverse-bias mode to limit the voltage resulting from said positive polarity voltage.

8. The downhole system of claim 1 further comprising an inductor electrically coupled to said Y-point of said downhole motor of said electrical submersible pump and said downhole measurement tool, said inductor being of selected inductance for filtering alternating current ripple voltage from said downhole motor of said electrical submersible pump to said downhole measurement tool.

9. A downhole measurement tool having a circuit capable of balancing an alternating current during a phase-to-ground fault condition, said downhole measurement tool capable of being coupled to a Y-point of a three-phase downhole motor of an electrical submersible pump, said circuit of said downhole measurement tool comprising:

a triggerable network that selectively conducts during application of a negative polarity voltage to said downhole measurement tool based on a rate of increase of said negative polarity voltage; and an inductor commutating circuit to limit the voltage resulting from a positive polarity voltage during said phase-to-ground fault condition.

10. The downhole measurement tool of claim 9 wherein said triggerable network comprises a silicon-controlled rectifier and an associated resistor that form a path of current conduction for said negative polarity voltage during said phase-to-ground fault condition.

11. The downhole measurement tool of claim 10 wherein said triggerable network further comprises a gate input of said silicon-controlled rectifier coupled to a resistor and a capacitor connected in series.

12. The downhole measurement tool of claim 11 wherein said silicon-controlled rectifier is a plurality of silicon-controlled rectifiers coupled to a plurality of resistors and a plurality of capacitors connected in series.

13. The downhole measurement tool of claim 12 wherein said resistors and said capacitors provide a trigger current for said silicon-controlled rectifiers, and wherein said resistors and said capacitors selectively control said conduction of said silicon-controlled rectifiers.

14. The downhole measurement tool of claim 13 wherein said trigger current is based on said rate of increase of said negative polarity voltage.

15. The downhole measurement tool for claim 9 wherein said inductor commutating circuit further comprises a diode providing a path of current conduction for a positive polarity voltage during said phase-to-ground fault condition and a plurality of zener diodes coupled in series and in a reverse-bias mode to limit the voltage resulting from said positive polarity voltage.

16. The downhole measurement tool of claim 9 further comprising an inductor being of selected inductance for filtering alternating current ripple voltage to said downhole measurement tool.

17. A method of balancing a phase-to-ground fault condition between a power cable or a three-phase downhole motor of an electrical submersible pump and a downhole measurement tool, said method comprising the steps of:

electrically coupling a Y-point of said downhole motor of said electrical submersible pump to said downhole measurement tool;

selectively conducting a negative polarity voltage to said downhole measurement tool during said phase-to-ground fault condition based on a rate of increase of said negative polarity voltage; and providing a path of current conduction for a positive polarity voltage during said phase-to-ground fault condition.

18. The method of claim 17 wherein said step of selectively conducting said negative polarity voltage is via a silicon-controlled rectifier and a network of resistors and capacitors that form a path of current conduction for said negative polarity voltage during said phase-to-ground fault condition.

19. The method of claim 18 further comprising the step of providing a triggerable network for said silicon-controlled rectifier based on said rate of increase of said negative polarity voltage.

20. The method of claim 19 wherein if said rate of increase of said negative polarity voltage is sufficient, causing said network of resistors and capacitors to provide said trigger current sufficient to trigger said silicon-controlled rectifier thereby causing said silicon-controlled rectifier to conduct current during said negative polarity voltage of said phase-to-ground fault condition.

21. The method of claim 19 wherein if said rate of increase of said negative polarity voltage is insufficient, causing said network of resistors and capacitors to provide said trigger current insufficient to trigger said silicon-controlled rectifier whereby said silicon-controlled rectifier does not conduct current.

* * * * *